US009193030B2

(12) United States Patent
Kalenian et al.

(10) Patent No.: US 9,193,030 B2
(45) Date of Patent: Nov. 24, 2015

(54) CMP RETAINING RING WITH SOFT RETAINING RING INSERT

(71) Applicant: Strasbaugh, San Luis Obispo, CA (US)

(72) Inventors: William J. Kalenian, San Luis Obispo, CA (US); Larry Spiegel, San Luis Obispo, CA (US)

(73) Assignee: Strasbaugh, San Luis Obispo, CA (US)

( * ) Notice: Subject to any disclaimer, the term of this patent is extended or adjusted under 35 U.S.C. 154(b) by 0 days.

(21) Appl. No.: 14/295,013

(22) Filed: Jun. 3, 2014

(65) Prior Publication Data

US 2014/0287657 A1 Sep. 25, 2014

Related U.S. Application Data

(63) Continuation of application No. 13/252,897, filed on Oct. 4, 2011, now Pat. No. 8,740,673.

(60) Provisional application No. 61/389,873, filed on Oct. 5, 2010.

(51) Int. Cl.
*B24B 37/32* (2012.01)

(52) U.S. Cl.
CPC ..... *B24B 37/32* (2013.01)

(58) Field of Classification Search
CPC ..... B24B 37/32; B24B 41/06; B24B 41/061; B24B 5/35; B24B 37/30
USPC ..... 451/41, 54, 56, 285–290, 397
See application file for complete search history.

(56) References Cited

U.S. PATENT DOCUMENTS

| | | | | |
|---|---|---|---|---|
| 6,019,670 | A * | 2/2000 | Cheng et al. | 451/56 |
| 6,019,868 | A * | 2/2000 | Kimura et al. | 156/345.14 |
| 6,024,630 | A * | 2/2000 | Shendon et al. | 451/41 |
| 6,139,428 | A * | 10/2000 | Drill et al. | 451/41 |
| 6,264,540 | B1 * | 7/2001 | Fruitman | 451/398 |
| 6,409,583 | B1 * | 6/2002 | Numoto | 451/259 |
| 6,569,771 | B2 * | 5/2003 | Lin et al. | 438/692 |
| 6,602,114 | B1 * | 8/2003 | Wang et al. | 451/41 |
| 6,786,809 | B1 * | 9/2004 | Held | 451/288 |
| 6,796,887 | B2 * | 9/2004 | Marquardt | 451/286 |
| 6,824,458 | B2 * | 11/2004 | Ensinger | 451/415 |
| 6,939,206 | B2 * | 9/2005 | Ashjaee et al. | 451/41 |
| 7,094,133 | B2 * | 8/2006 | Masunaga et al. | 451/54 |
| 7,485,028 | B2 * | 2/2009 | Wilkinson et al. | 451/41 |
| 7,722,439 | B2 * | 5/2010 | Torii | 451/41 |
| 7,857,683 | B2 * | 12/2010 | Burns et al. | 451/286 |
| 7,867,060 | B2 * | 1/2011 | Aritomo et al. | 451/36 |
| 8,029,640 | B2 * | 10/2011 | Zuniga et al. | 156/345.14 |
| 8,298,046 | B2 * | 10/2012 | Frank et al. | 451/286 |
| 8,556,684 | B2 * | 10/2013 | Sather et al. | 451/285 |
| 8,740,673 | B2 * | 6/2014 | Kalenian et al. | 451/397 |
| 2005/0215181 | A1 * | 9/2005 | Wilkinson et al. | 451/41 |
| 2006/0194519 | A1 * | 8/2006 | Fuhriman et al. | 451/41 |
| 2007/0298693 | A1 * | 12/2007 | Ichinoshime | 451/285 |
| 2008/0051011 | A1 * | 2/2008 | Moloney et al. | 451/41 |

* cited by examiner

*Primary Examiner* — George Nguyen
(74) *Attorney, Agent, or Firm* — K. David Crockett, Esq.; Crockett & Crockett, PC

(57) ABSTRACT

A method of polishing a wafer with a wafer carrier adapted to further reduce the edge effect and allow a wafer to be uniformly polished across its entire surface, with a retaining ring made from very hard materials such as PEEK, PET or polycarbonate with a hardness in the range of 80 to 85 Shore D, while the inner surface or insert is made of polyurethane or other material with a hardness in the range of 85 to 95 Shore A.

8 Claims, 5 Drawing Sheets

12
10
1
11
5
5
4
2
13
2
3
3
8
8
9
9
7
6

Film removal in Angstroms, at a radius of 67 mm

Film removal in Angstroms, at a radius of 67 mm

CMP RETAINING RING WITH SOFT RETAINING RING INSERT

This application is a continuation of U.S. application Ser. No. 13/252,897, filed Oct. 4, 2011, now U.S. Pat. No. 8,740,673, which claims priority to U.S. Provisional Application 61/389,873, filed Oct. 5, 2010.

FIELD OF THE INVENTIONS

The inventions described below relate the field of wafer carriers and particularly to wafer carriers used during chemical mechanical planarization of silicon wafers.

BACKGROUND OF THE INVENTIONS

Integrated circuits, including computer chips, are manufactured by building up layers of circuits on the front side of silicon wafers. An extremely high degree of wafer flatness and layer flatness is required during the manufacturing process. Chemical-mechanical planarization (CMP) is a process used during device manufacturing to flatten wafers and the layers built-up on wafers to the necessary degree of flatness.

Chemical-mechanical planarization is a process involving polishing of a wafer with a polishing pad combined with the chemical and physical action of a slurry pumped onto the pad. The wafer is held by a wafer carrier, with the backside of the wafer facing the wafer carrier and the front side of the wafer facing a polishing pad. The polishing pad is held on a platen, which is usually disposed beneath the wafer carrier. Both the wafer carrier and the platen are rotated so that the polishing pad polishes the front side of the wafer. A slurry of selected chemicals and abrasives is pumped onto the pad to affect the desired type and amount of polishing. (CMP is therefore achieved by a combination of chemical softener and physical downward force that removes material from the wafer or wafer layer.)

Using the CMP process, a thin layer of material is removed from the front side of the wafer or wafer layer. The layer may be a layer of oxide grown or deposited on the wafer or a layer of metal deposited on the wafer. The removal of the thin layer of material is accomplished so as to reduce surface variations on the wafer. Thus, the wafer and layers built-up on the wafer are very flat and/or uniform after the process is complete. Typically, more layers are added and the chemical mechanical planarization process is repeated to build complete integrated circuit chips on the wafer surface. Wafers are provided with flat edges or notches that are used to orient the wafers for various steps in the process. Wafers are provided in uniform sizes, including 150 mm wafers which have been available for some time and are typically flat edged (called flatted wafers), and newer 200 mm and 300 mm wafers which are round and notched (called round wafers or notched wafers).

In the process addressed by the devices and methods described below, a flat wafer is polished with a carrier with a retaining ring with an internal shape matching the flatted wafer. The retaining ring is slightly over-sized, compared to the wafer, to allow for enough room to automatically load the wafers into the carrier. The slight margin between the wafer and the retaining ring provides a small bit of room for the wafer to wobble relative to the ring, and this in turn leads to variance in the polishing rate a few millimeters from the flat edge vis-à-vis the remainder of the wafer. This is referred to as an edge effect.

SUMMARY

The methods and devices described below provide for a wafer carrier adapted to further reduce the edge effect and allow a wafer to be uniformly polished across its entire surface. In a system for chemical mechanical planarization of flat-edge wafers, a retaining ring with a relatively soft inner surface is used to provide for more uniform polishing of the wafer. The soft inner surface can be provided with lining or ring insert disposed within an annular rabbet around the inner edge of the retaining ring. The retaining ring is made from very hard materials such as PEEK, PET or polycarbonate with a hardness in the range of 80 to 85 Shore D, while the inner surface or insert is made of polyurethane or other material with a hardness in the range of 85 to 95 Shore A (which corresponds to 33 to 46 Shore D).

DETAILED DESCRIPTION OF THE INVENTIONS

Figure 1:
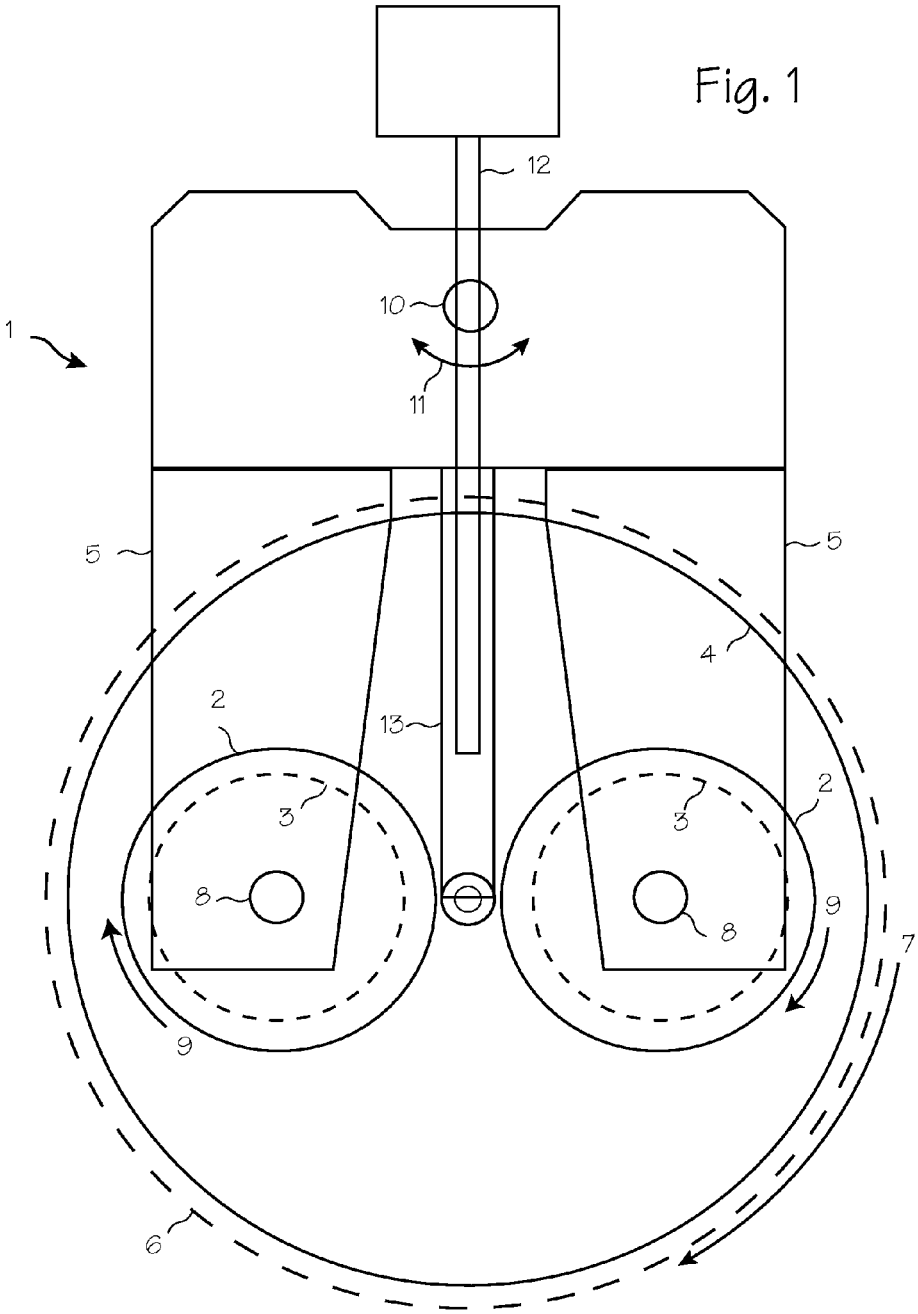
FIG. 1 shows a system for performing chemical mechanical planarization.

FIG. 1 shows a system 1 for performing chemical mechanical planarization. One or more polishing heads or wafer carriers 2 hold wafers 3 (shown in phantom to indicate their position underneath the wafer carrier) suspended over a polishing pad 4. The wafer carriers are suspended from translation arms 5. The polishing pad is disposed on a platen 6, which spins in the direction of arrows 7. The wafer carriers 2 rotate about their respective spindles 8 in the direction of arrows 9. The wafer carriers are also translated back and forth over the surface of the polishing pad by the translating spindle 10, which moves as indicated by arrows 11. The slurry used in the polishing process is injected onto the surface of the polishing pad through slurry injection tube 12, which is disposed on or through a suspension arm 13. (Other chemical mechanical planarization systems may use only one wafer carrier that holds one wafer, or may use several wafer carriers that hold several wafers. Other systems may also use separate translation arms to hold each carrier.)

Figure 2:
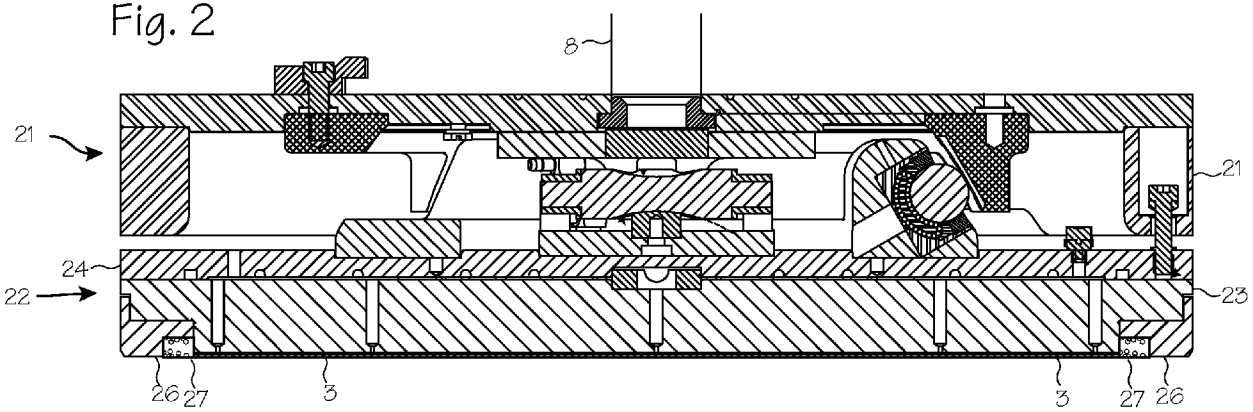
FIG. 2 shows a cross section of the wafer carrier with a retaining ring.

FIGS. 2 is a cross section of the wafer carrier with retaining ring used to retain the wafer under the wafer carrier.

The wafer carrier includes a housing 21 disposed over a manifold plate or pressure plate assembly 22. The carrier housing connects to the spindle 8 and the pressure plate. The interior structures of the housing are described in our prior patent Walsh, et al., *Wafer Carrier Pivot Mechanism*, U.S. Pat. No. 7,156,946 (Jan. 2, 2007) and are used to translate rotation of the spindle to the pressure plate and thus to the wafer, while allowing pivoting relative to the horizontal plan to accommodate for friction during polishing. The pressure plate assembly 22, which provides means for securing the wafer to the wafer carrier, comprises a wafer mounting plate 23 a pressure plate 24, a retaining ring assembly 25 which includes the retaining ring 26 and the retaining ring insert 27.

The retaining ring is disposed about the outer periphery of the pressure plate and wafer mounting plate and establishes a wide, shallow, round recess under the wafer mounting plate in which the wafer 3 resides during polishing. While the carrier is spinning and swiping over the rotating platen, the retaining ring confines the wafer, keeping it in place under the pressure plate and mounting plate. Typically, the retaining ring is made of polyetheretherketone (PEEK), polyphenylene sulfide (PPS), or polycarbonate. The retaining ring is worn away during the polishing process, so the choice of materials used for the retaining ring has been limited to very hard plastics which will not wear away quickly and will not react with the slurry or contaminate the surface of the polished wafer.

Figure 3:
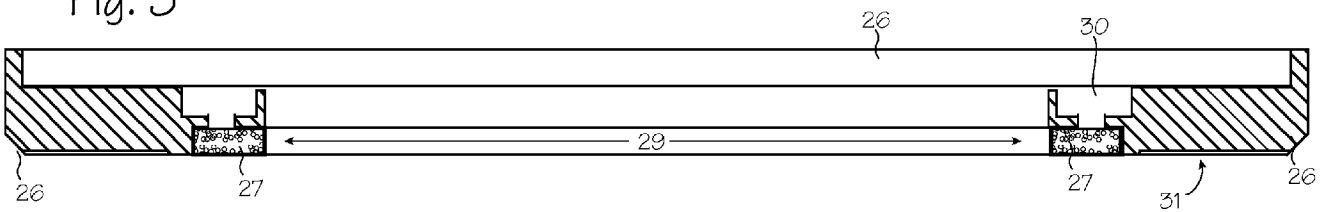
FIG. 3 shows a cross section of the retaining ring assembly with a retaining ring with a ring insert disposed within a rabbet on the inner surface of the retaining ring.

FIG. 3 shows a cross section of the retaining ring with a ring insert. The retaining ring is a toroid or generally toroidal or annular ring, characterized by an outer diameter and an inner diameter. The inner diameter 29 is chosen to closely match the wafer with which it used, leaving a small margin of about 0.5 mm. As shown in FIG. 3, the inner edge is rabbeted, providing an annular rabbet or counterbore which accommodates the ring insert. The ring insert forms the inner surface of the retaining ring which impinges on the wafer during polishing operations. The retaining ring is made of typical materials used for the retaining ring, which are very hard, in the range of 80 Shore D (polycarbonate) to 85 Shore D (PEEK and PPS). The insert 27 is made of polyurethane or other material with a hardness in the range of 85 to 95 Shore A (which corresponds to 33 to 46 Shore D), and is preferably comprised of polyurethane with a hardness of 90 Shore A (about 39 Shore D)(Hockey pucks, by comparison, are about 90 Shore A). Polyurethane can be formulated in a wide range of hardness, and may be readily formulated at 90 Shore A. The insert 27 is preferably about 27.3 mm wide (about 1 inch), with an inner diameter of 150.50 (5.925 inches) and an outer diameter of 177.8 mm (7.0 inches). The insert is preferably entirely, or substantially entirely, composed of a single material such as polyurethane of 90 Shore A, or materials of like hardness, and its inner surface, which comes into contact with the wafer, is preferably entirely comprised of polyurethane of 90 Shore A or materials of like hardness.

Figure 4:
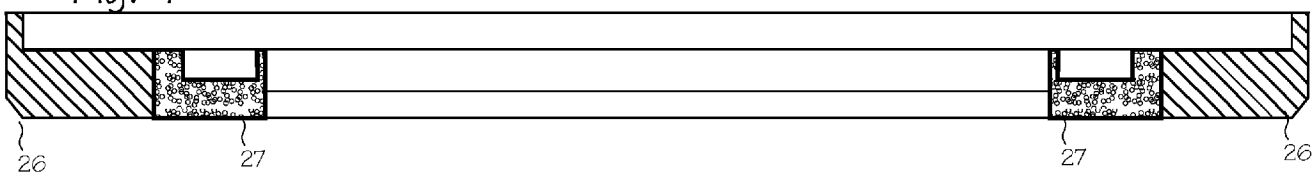
FIG. 4 shows a cross section of the retaining ring assembly with a ring insert disposed over the entire vertical inner surface of the retaining ring.

FIG. 4 shows a cross section of the retaining ring with a two-part structure, including a first outer ring of hard material and a second inner ring of relatively soft material, as described above. Again, the retaining ring is a toroid or generally toroidal or annular ring, characterized by an outer diameter and an inner diameter. The ring insert of FIG. 4 forms the inner surface of the retaining ring which impinges on the wafer during polishing operations. The first, outer ring 26 of the retaining ring is made of typical materials used for the retaining ring, which are very hard, in the range of 80 Shore D (polycarbonate) to 85 Shore D (PEEK and PPS) (Bowling balls, by comparison, must be at least 72 Shore D). The second, inner ring is made of polyurethane or other material with a hardness in the range of 85 to 95 Shore A (which corresponds to 33 to 46 Shore D), and is preferably comprised of polyurethane with a hardness of 90 Shore A (about 39 Shore D). Polyurethane can be formulated in a wide range of hardness, and may be readily formulated at 90 Shore A. The inner ring can be formed in a thin lining, with an inner diameter of 150.5 and an outer diameter of 151.5, for an overall thickness of 1 mm, or it may be as thick as 27 mm as it is in FIG. 3. Other features of the retaining ring assembly may include the annular channel 30 which may accommodate a ring seal, and peripheral recesses 31 which allow for slurry flow.

Figure 5:
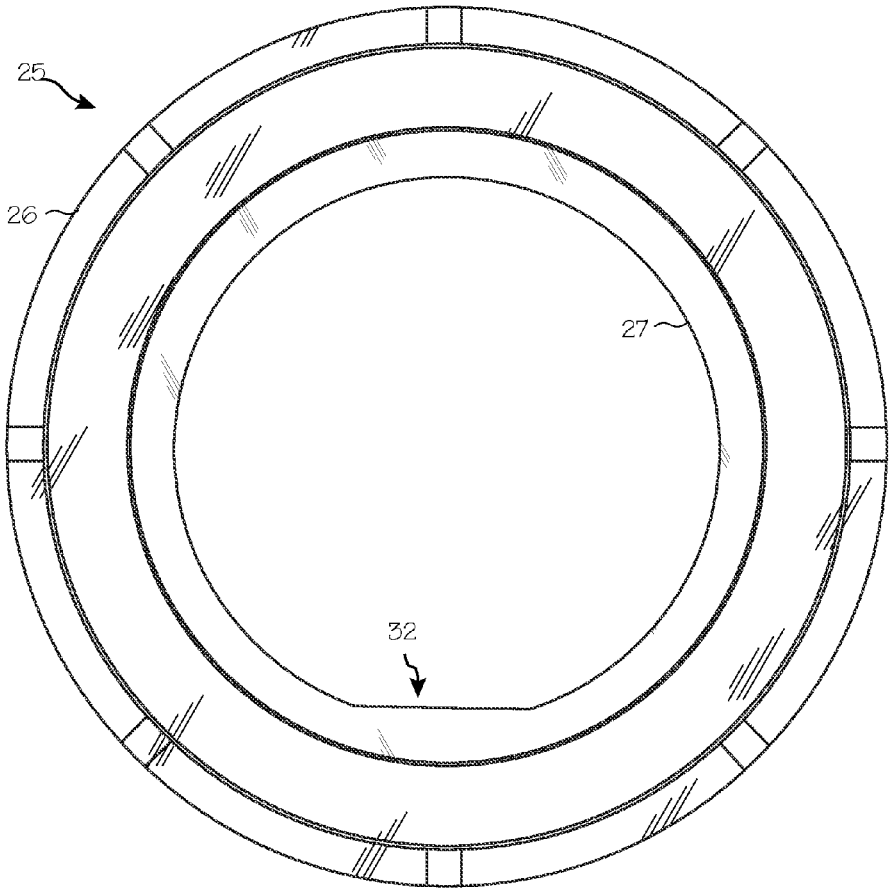
FIG. 5 is a bottom view of the retaining ring assembly.

FIG. 5 is a bottom view of the ring insert of FIG. 3 or 4. This figures shows the retaining ring assembly 25, retaining ring 26 and retaining ring insert 27, and shows the flat area 32 of the insert inner edge, which matches the flat of the wafer which fits within the retaining ring assembly.

In use, a wafer is mounted in the carrier, held over a polishing pad, and pressed into the pad while rotating the pad and the carrier. The carrier and CMP system are operated as normal, and stopped when the polishing endpoint is achieved.

Figure 6:
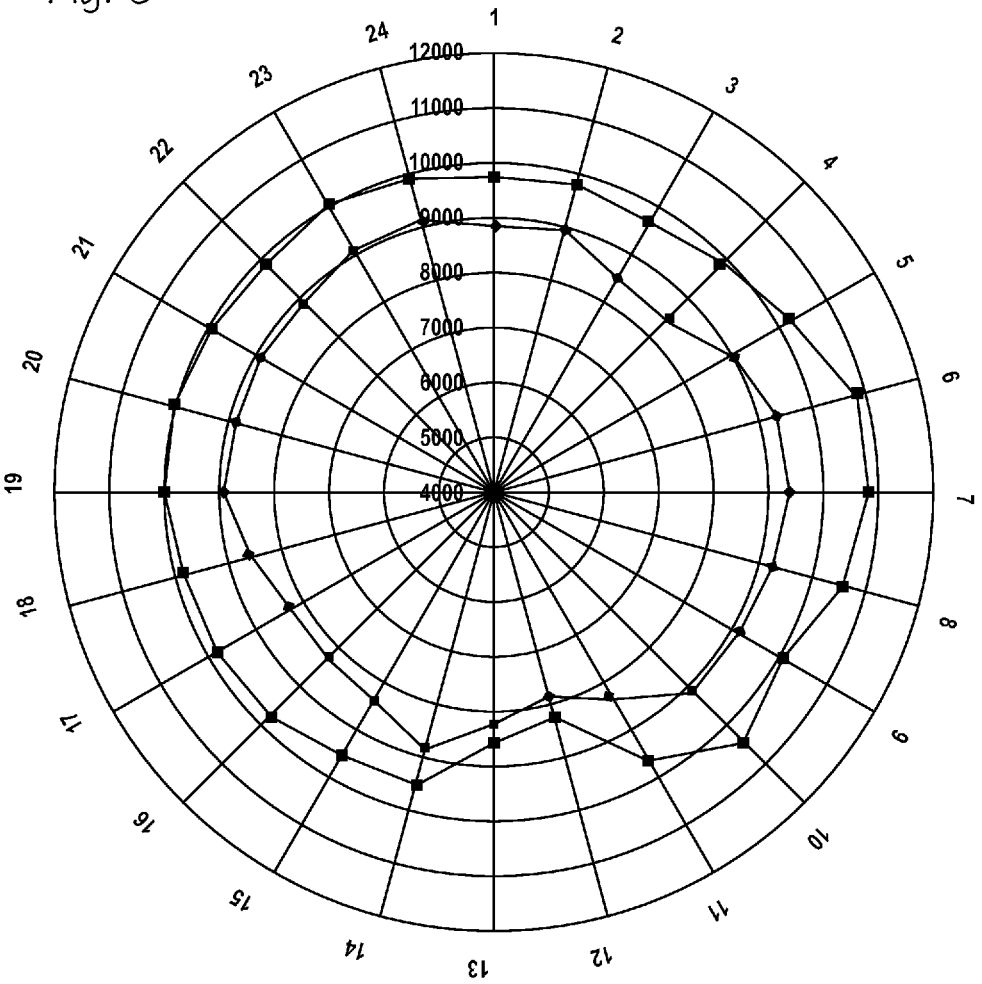
FIGS. 6 and 7 are radar graphs showing the removal at various radial positions on a wafer for wafers polished in systems fitted with prior art hard retaining rings and the new retaining ring the insert.
Figure 7:
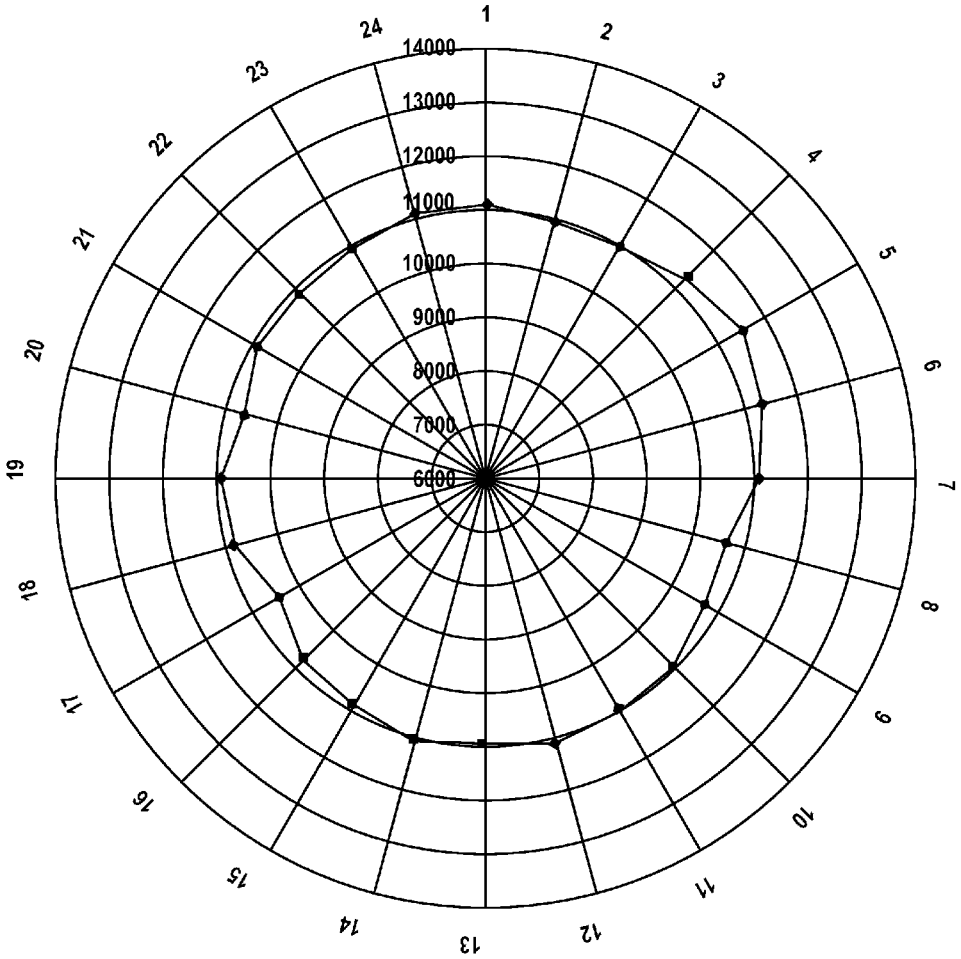

The results, when compared to polishing with a single piece PEEK retaining ring, are significantly improved. FIGS. 6 and 7 are radar graphs showing the removal at various radial positions on a wafer for wafers polished in systems fitted with prior art hard retaining rings (FIG. 6) and the new retaining ring with the soft insert (FIG. 7). FIG. 6 shows a radar graph of film removal versus radial position on the wafer, at a diameter of 67 mm from the center of the wafer (8 mm in from the round edge), for a pair of wafers polished using a single-piece PEEK retaining ring. Locations 12, 13 and 14 correspond to the wafer flat. The graph illustrates that the removal is only 8000 to 9000 Å near the flat, while the removal at 90° from the flat (positions 6, 7 and 8) is 10000 to 13000 Å, with additional low removal at positions 1, 2 3 and 4, and high removal of 9000 to 11000 Å in positions 15 through 24. In comparison, the radar graph of wafers polished with the new retaining ring show high uniformity. As shown in FIG. 7, at all radial positions, the removal it very close to 11000 Å, with variance from only about 10500 to 11500 Å. The sharp variation in removal at the area corresponding to the flat of the wafer has been eliminated through use of the two-part retaining ring.

The illustrations of FIGS. 3 and 4 illustrate a retaining ring assembly with discrete inner ring and outer ring portions. As illustrated, the retaining ring assembly comprising a first outer ring comprises a material having a first hardness and a second, inner ring disposed coaxially within the first outer ring having a second hardness which is less than the first hardness. The retaining ring may be made of a single ring, characterized by an outer radial portion and an inner radial portion, with outer radial portion having a hardness greater than the hardness of the inner radial portion.

While the preferred embodiments of the devices and methods have been described in reference to the environment in which they were developed, they are merely illustrative of the principles of the inventions. The elements of the various embodiments may be incorporated into each of the other species to obtain the benefits of those elements in combination with such other species, and the various beneficial features may be employed in embodiments alone or in combination with each other. Other embodiments and configurations may be devised without departing from the spirit of the inventions and the scope of the appended claims.

We claim:

1. A method of polishing a wafer in a CMP process, said method comprising the steps of:

providing a wafer carrier comprising:

a carrier housing;

a wafer mounting plate disposed beneath the carrier housing;

a retaining ring assembly disposed about a lower portion of the wafer mounting plate, said retaining ring assembly comprising a first outer ring and a second, inner ring disposed coaxially within the first outer ring; wherein the first outer ring comprises a material having a hardness in the range of 80 to 85 Shore D, and the inner ring comprises a material having a hardness in the range of 85 to 95 Shore A;

placing a wafer below the wafer mounting plate; and rotating the wafer carrier over a polishing pad to polish a surface of the wafer.

2. A method of polishing a wafer in a CMP process, said method comprising the steps of:

providing a wafer carrier comprising:

a carrier housing;

a wafer mounting plate disposed beneath the carrier housing;

a retaining ring assembly disposed about a lower portion of the wafer mounting plate, said retaining ring assembly comprising a first outer ring and a second, inner ring disposed coaxially within the first outer ring; wherein the first outer ring comprises a material having a hardness in the range of 80 to 85 Shore D, and the inner ring comprises a material having a hardness in the range of 33 to 46 Shore D;

placing a wafer below the wafer mounting plate; and rotating the wafer carrier over a polishing pad to polish a surface of the wafer.

3. The method of claim 2, wherein the inner ring comprises a material having a hardness of about 39 Shore D.

4. The method of claim 2, wherein the first outer ring comprises PEEK, PET or polycarbonate, and the inner ring comprises polyurethane.

5. A method of polishing a wafer in a CMP process, said method comprising the steps of:

providing a wafer carrier comprising:

a carrier housing;

a wafer mounting plate disposed beneath the carrier housing;

a retaining ring disposed about a lower portion of the wafer mounting plate, said retaining ring characterized by an outer radial portion and an inner radial portion; wherein the outer radial portion comprises a material having a hardness in the range of 80 to 85 Shore D, and the inner radial portion comprises a material having a hardness in the range of 85 to 95 Shore A;

placing a wafer below the wafer mounting plate; and rotating the wafer carrier over a polishing pad to polish a surface of the wafer.

6. A method of polishing a wafer in a CMP process, said method comprising the steps of:

providing a wafer carrier comprising:

a carrier housing;

a wafer mounting plate disposed beneath the carrier housing;

a retaining ring disposed about a lower portion of the wafer mounting plate, said retaining ring characterized by an outer radial portion and an inner radial portion; wherein the outer radial portion comprises a material having a hardness in the range of 80 to 85 Shore D, and the inner radial portion comprises a material having a hardness in the range of 33 to 46 Shore D;

placing a wafer below the wafer mounting plate; and rotating the wafer carrier over a polishing pad to polish a surface of the wafer.

7. The method of claim 6, wherein the inner radial portion comprises a material having a hardness of about 39 Shore D.

8. The method of claim 6, wherein: the first outer ring comprises PEEK, PET or polycarbonate, and the inner ring comprises polyurethane.

* * * * *